United States Patent [19]

Anderson

[11] 4,353,545

[45] Oct. 12, 1982

[54] ATHLETIC REFLEX MACHINE

[76] Inventor: Tyrone D. Anderson, 903 N. Kenwood Ave., Baltimore, Md. 21205

[21] Appl. No.: 239,904

[22] Filed: Mar. 3, 1981

[51] Int. Cl.[3] ..... A63B 69/34

[52] U.S. Cl. ..... 272/76; 273/1 GE

[58] Field of Search ..... 272/76; 273/1 F, 1 G, 273/1 GE

[56] References Cited

U.S. PATENT DOCUMENTS

| | | | |
|---|---|---|---|
| 805,543 | 11/1905 | Hayes | 272/76 |
| 931,818 | 8/1909 | Valentine | 272/76 |
| 3,804,406 | 4/1974 | Viscione | 272/76 |

*Primary Examiner*—George J. Marlo
*Attorney, Agent, or Firm*—John F. McClellan, Sr.

[57] ABSTRACT

Martial-arts practice apparatus includes an upright panel with a plurality of pneumatically actuable strikers valve-controlled to lash-out toward the user and retract in simulation of weaponless combat; sequence of actuation of the strikers is determinable by a motor driven lobe-roll with adjustable lobes or cams for actuating the striker-control valves, or without this provision, manually by depression of valve actuators in any sequence desired, permitting a colleague of the user to engage in a contest with the user through selective actuation of the strikers; two or more strikers can be actuated to lash out simultaneously.

4 Claims, 3 Drawing Figures

ATHLETIC REFLEX MACHINE

This invention relates generally to human athletics and specifically to apparatus for practicing fighting without weapons, in the nature of Judo, Karate and the like.

OBJECTS OF THE INVENTION

A principal object of the invention is to provide a system which can simulate the blows of an opponent directed at the user of the system from a number of levels at a number of side-to-side positions with either automatic repetition at a selectable repetition rate in a predetermined program, or as manually programmed and activated in any desired order by an assistant.

In the automatic mode the user and the system play a game. When manually activated by an assistant the thrust and parry can become a game between the assistant and the user. In any case further objects are to quicken reflexes, improve skills, and exercise and strengthen the body, all in an interesting competitive manner.

Still further objects are to provide apparatus which strikes blows as fast or as slowly as desired but which does not injure the recipient when blows are struck, which uses self-retracting strikers, power-vented for fast, positive action in extending and retracting.

Yet further objects are to provide first positive pressure means for inflating each striker and second positive pressure means for deflating each striker.

BRIEF SUMMARY OF THE INVENTION

In brief summary given as cursive description only and not as limitation the invention includes a plurality of strikers actuable to lash-out at the user from a variety of locations simulating blows directed at the user in martial arts, under the control of a master pneumatic keyboard manually operable, or as an option, operable by a changeable program motorized lobe roll.

BRIEF DESCRIPTION OF THE DRAWINGS

The above and other objects and advantages of the invention will become more readily understood on examination of the following description, including the drawings in which like characters refer to like parts.

DETAILED DESCRIPTION OF THE DRAWINGS

Figure 1:
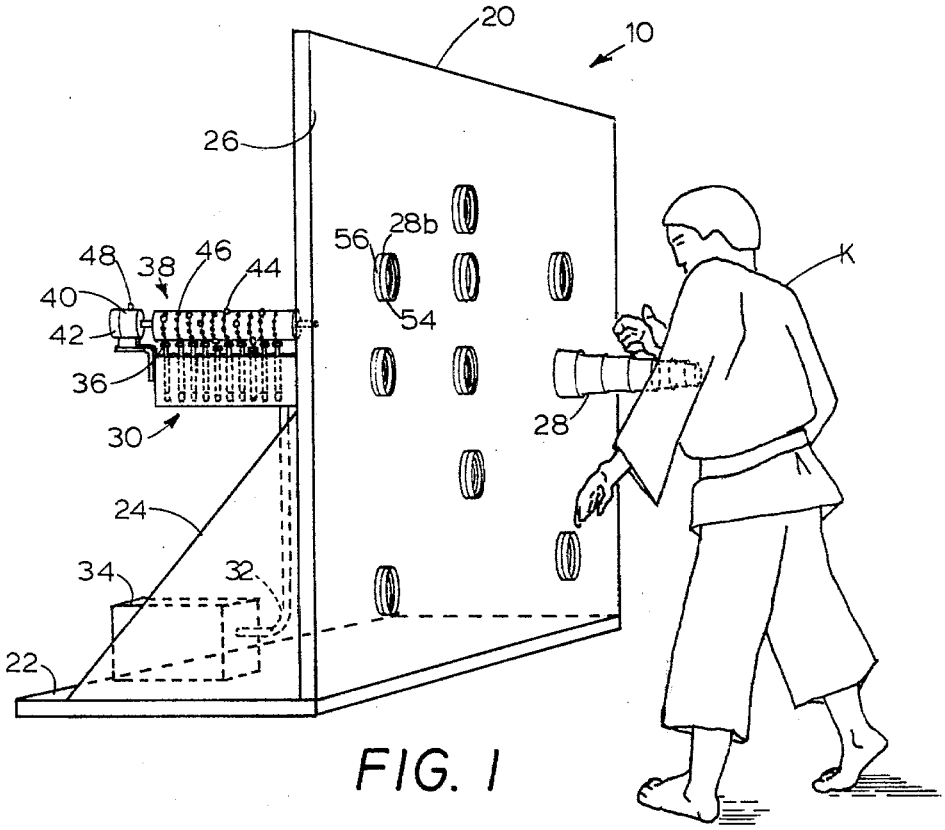
FIG. 1 is a perspective view of the invention in preferred embodiment with a striker extending toward a user practicing martial arts.

FIG. 1 shows the invention 10 as having an upstanding panel 20 held by a base 22 extending toward the rear and diagonal braces 24 shown.

Lashing out at the Karate practicer or user K from the front face 26 of the panel is a striker 28. This may be one of ten or more similar strikers disposed on the front face in any desired pattern, here the pattern being symmetrical about the vertical centerline and having the following numbers of strikers in each vertically spaced row, counting down:

1, 3, 3, 1 simulating head, arm and leg positions.

The strikers are pneumatically inflated to lash out and are self retracting on signal as will be described, all under the direction of a controller 30 which may be conventionally mounted at a cantilever on the rear face of the panel, and is supplied through a pipe 32 with compressed air from a source such as pump 34 on the base.

The controller comprises a linear keyboard array of valve actuators 36. These may be manually depressed by a colleague of the user, who may actually play a game with the user, seeing how many surprise or unparried blows of the strikers he can land on the user.

As an alternative, a lobe roll or cam-roll programmer 38 with electric drive motor 40 to rotate the lobe roll, can be mounted as shown above the controller and in alignment with the row of valve actuators. When rotated by the motor the respective arrangements of lobes or cam elements depress the valve actuators and cause particular strikers to lash out and retract in a predeterminable sequence.

Speed of the routine or repetition rate of lashing out, all other things being equal, may be adjustable by a conventional adjustment of motor speed, as by a silicon controlled rectifier on the motor, represented at 42.

For variety, the individual lobes or cam elements 44 may be repositionable for variety in a ring of holes 46 provided in the lobe roller at each actuator valve location, and more than one cam element can be used per ring of holes. Motor rotation is in a preferred direction as will be explained; occasionally turning off the motor for an instant by switch 48 can produce a different rhythm of lashing out by the strikers. Two or more strikers can be actuated to lash out simultaneously.

Figure 2:
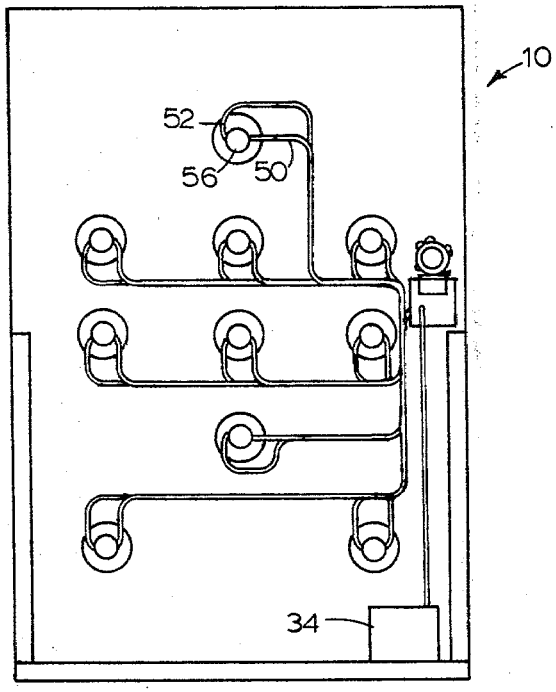
FIG. 2 is a rear elevational view of the FIG. 1 showing.

FIG. 2 shows the rear elevational view of the invention. Each valve in the controller controls a particular striker, and for the purpose two pneumatic hoses 50, 52 for example, lead from each valve to the particular striker mechanism controlled at 56.

Figure 3:
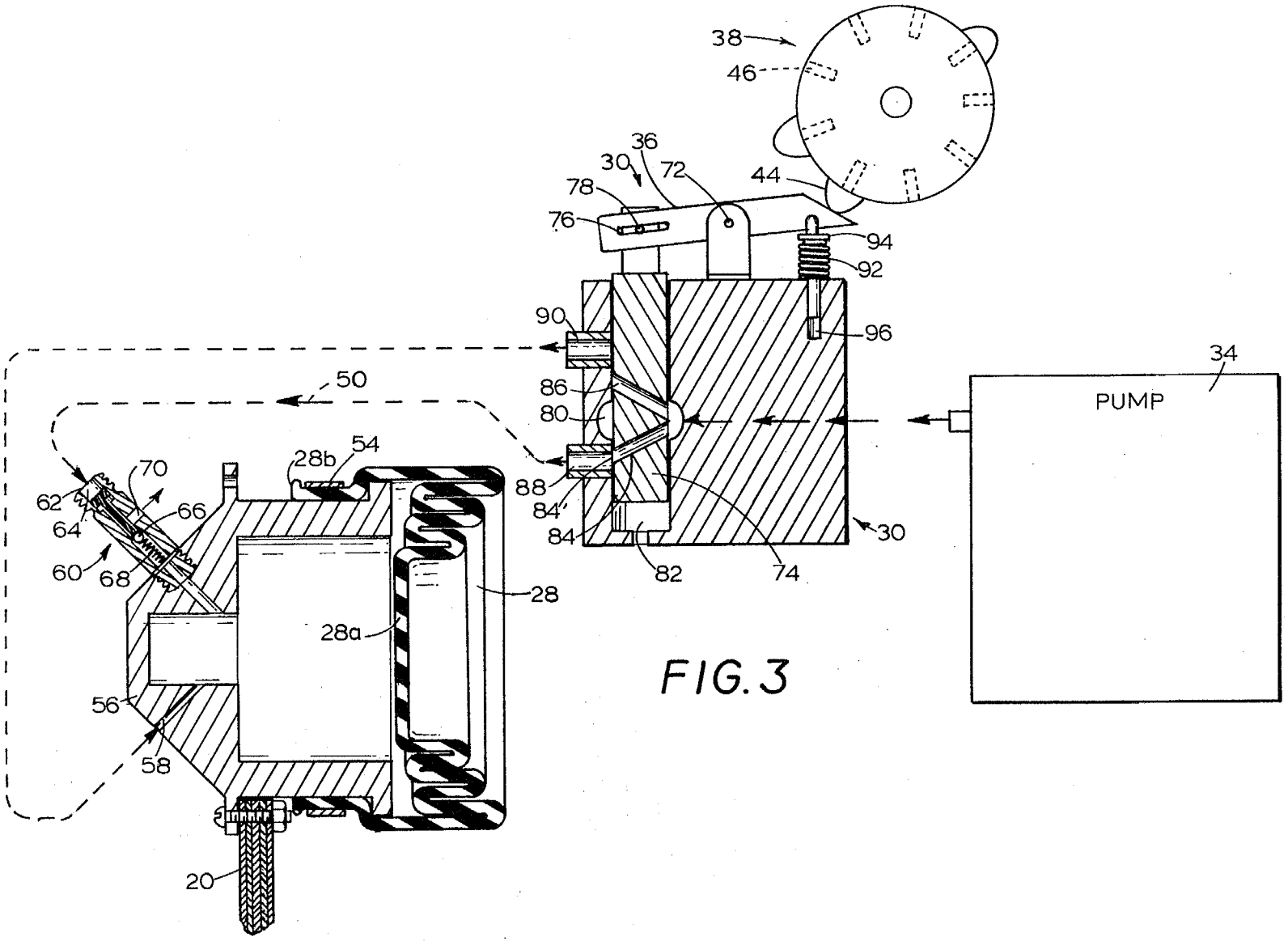
FIG. 3 is a system diagram with elements not necessarily shown in relative scale.

FIG. 3 diagrams the relations and operations of elements of the system.

Each striker 28 may be an inverted bellows, with closed end **28*a* extensible through pneumatic coupling of the open end 28*b* by a hose clamp 54 to the open end of a manifold 56. A few convolutions are shown for exposition; many more convolutions can be used. Spring wire may be wound in the bellows to held draw it back, and, if desired, a tension spring may be attached between the centers of members 28*a* and 56 to help draw the bellows back. Sizes for air passages may be much larger than shown, throughout, for speediest operation practicable. The manifold is cup-shaped and secured, open end forward, through a hole in the panel 20** by screws or other conventional means.

Compressed air admitted through a first or inflation port 58, extends the striker, which because of the inverted-bellows shape tapers down from open end to closed end will tend to snap-out from the retracted position and to extend faster; the taper will also tend to cause speedier initial retraction. The striker can be of rubber and may have any conventional means to speed retraction such as a rubber spring, or a metal coil spring on the inside. Prior to retraction the compressed air supply is shut off from the first part.

For retraction, air is expelled from the striker through an exhaust valve 60. Retraction is caused by admission of compressed air to a second port, or exhaust actuation port 62 in the exhaust valve causing a portion of piston 64 to advance unseating ball 66 against the force of spring 68, and permitting air to escape past the ball and through exhaust passage 70. The valve action is similar to that in letting air out of a tire, but faster.

As noted, the controller 30 directs the operations of inflation and deflation of each striker, either under manual actuation of the valves or else, as shown here under actuation of the roll-lobe 44. As each lobe, adjustably located in a particular hole of a ring of lobe holes 46, passes and depresses a respective control-valve arm or valve actuator 36 by means of a fulcrum 72 this lifts the particular control valve body 74, which is engaged by a slot 76 and pin 78.

Lifting the control valve body 74 results in distribution of compressed air (from pump 34) which is in longitudinal circular bore 80 extending substantially the length of the controller and serving each control valve equally, either into the first port 58, or the second port 62, at the manifold, as follows. Each valve body 74 is a cylindrical piston, fits in a cylinder 82, and has through it lower and upper diagonal bores 84, 86. Each diagonal bore has a first end and a second end. The first ends are adjacent each other; both communicate with the longitudinal circular-section bore 80 at all times. This bore should be located about halfway between the lower outlet 88 and upper outlet 90. "O" ring seals, not shown, may be used throughout in accordance with conventional practice.

In operation when at assembly 38 a lobe 44 raises the control valve body 74 to coincidence with upper outlet 90, compressed air from pump 34 passes from longitudinal circular bore 80 in 30 through passage 86 and outlet 90 to inflation port 58, causing striker 28 to lash out.

When actuator 36 slips off lobe 44, spring 92 biases actuator 36 up, lowering valve body 74 so that compressed air from bore 80 travels through second portion 84' of passage 84 to outlet 88 and then through compressed air line 50 to exhaust valve 60.

The bores 84 and 86 are so-located relative to the outlets 88, 90 that they do not communicate with both at the same time, but instead one shuts off before the other connects.

The diagonal bores and associated mechanism are thus first positive pressure means for inflating a bellows and second positive pressure means for deflating a bellows.

Following retraction of the striker, continued rotation of the programmer causes the lobe or cam-element 44 to slip off the end of the controller valve arm 36 permitting spring 92, held by headed, bifurcate plunger 94 in bore 96 under the free end of the controller valve arm, to snap the valve body back to a lowermost or starting position at which the lower diagonal bore 84 and the upper diagonal bore 86 may be blanked-off from the outlets by the wall of the cylinder 82. The bottom of the cylinder may be vented for faster actuation.

Materials for the invention are conventional; suitable metal or plastics may be used for the valve apparatus and supporting structures.

This invention is not to be construed as limited to the particular forms disclosed herein, since these are to be regarded as illustrative rather than restrictive. It is, therefore, to be understood that the invention may be practiced within the scope of the claims otherwise than a specifically described.

What is claimed and desired to be protected by United States Letters Patent is:

1. A system for athletic practice to sharpen the skills of a user in avoiding and parrying blows as in Karate and the like, comprising: means for lashing out at the user with a succession of blows from a plurality of levels and directions, means for programming said lashing out, including a plurality of valving means, the means for lashing out including a plurality of strikers, means for connecting each of said strikers for response to a respective valving means, each of said strikers including a bellows inflatable through a respective said valving means and a respective said means for connecting.

2. A system as recited in claim 1, the means for programming including a manual keyboard for controlling the plurality of valving means, each bellows being an elastic bellows with an open end and a closed end and tapering in size from the open end to the closed end.

3. A system as recited in claim 2, the means for programming further including a lobe-roll aligned with said manual keyboard in position for actuating the respective valving means upon rotation of the lobe roll, motor means for rotating the lobe roll, and means for changing repetition rate of said lashing out, comprising means for changing speed of said motor means.

4. A system as recited in claim 1, first means for inflating each bellows and second means for deflating each bellows comprising: said means connecting further including each valving means having a connection for actuating said first means upon actuation of said valving means, and for actuating said second means upon further actuation of said valving means.

* * * * *